US006662401B2

(12) United States Patent
Zorzo

(10) Patent No.: US 6,662,401 B2
(45) Date of Patent: Dec. 16, 2003

(54) WRINGING TOOL FOR MOPS

(75) Inventor: Bruno Zorzo, Villa del Conte (IT)

(73) Assignee: Filmop S.r.l., Villa del Conte (IT)

( * ) Notice: Subject to any disclaimer, the term of this patent is extended or adjusted under 35 U.S.C. 154(b) by 104 days.

(21) Appl. No.: 10/060,555

(22) Filed: Jan. 29, 2002

(65) Prior Publication Data

US 2002/0112310 A1 Aug. 22, 2002

(30) Foreign Application Priority Data

Feb. 20, 2001 (IT) ..... PD2001A0038

(51) Int. Cl.[7] ..... A47L 13/60
(52) U.S. Cl. ..... 15/262
(58) Field of Search ..... 15/262

(56) References Cited

U.S. PATENT DOCUMENTS

| | | | | | |
|---|---|---|---|---|---|
| 1,922,981 | A | * | 8/1933 | Robertson | 15/262 |
| 4,852,207 | A | * | 8/1989 | Yamane | 15/262 |
| 5,175,904 | A | * | 1/1993 | Pagani | 15/262 |
| 5,548,865 | A | * | 8/1996 | Pagani | 15/262 |

* cited by examiner

*Primary Examiner*—Mark Spisich
(74) *Attorney, Agent, or Firm*—Thomas S. Baker, Jr.

(57) ABSTRACT

A wringing tool for mops having a box structure without a top cover or a bottom cover. Its top and bottom openings enable mops and their supports to pass through the tool for rinsing in a basin below the wringing tool. The oscillatory movement of the pressure roller is carried out by a control hand lever integral with an inner toothed gear which meshes with a gear placed on a shaft which is integral with oscillation levers supporting a pressure roller. The pressure roller works against a curved wall.

28 Claims, 9 Drawing Sheets

WRINGING TOOL FOR MOPS

FIELD OF THE INVENTION

In the market there are several types of wringing tools for mops having a single, freely rotating roller mounted on the end of a pair of oscillating arms which are fixed on a pivoting shaft supported in the top part of a box structure for a mop bucket open at the top. The pivoting shaft is rotated by a hand lever, while a roller, which is coaxial or substantially coaxial with this shaft and supported by oscillating arms, moves in front of a bent wringing surface corresponding to a part of a surface of a cylinder which is coaxial with the aforesaid pivoting shaft. Between the roller surface and the wringing surface there is a uniform or a substantially uniform opening for the roller which is moved by an oscillation motion of the oscillating arms. Some of the afore described wringing tools, with a roller working against a bent wringing surface, to improve their functioning, are provided with springs inside each of their oscillating arms. These springs exert a thrust force on the movable roller which presses against the wringing surface.

At this point, it must be remembered that the overall dimensions of the box constituting the wringing tool's framework must be contained both as regards width and as regards length because they cannot be larger than the structures the wringing tools are to applied to. Among the above mentioned wringing tools there is the tool of Japanese model 52.347, the wringing tool of U.S. Pat. No. 4,852,207 to Yamane, and the wringing tool of EP 480 327 to VDM s.r.l.

In order to move the arms directly by the hand lever, only one shaft is used and both the lever and the arms are fixed thereto. Indirect moving is carried out by two shafts. On one shaft the hand lever is fitted while on the other shaft the arms are fixed.

It is one of the fundamental principles of mechanics that for the multiplication and gearing down of the motion between two shafts, (what the shaft transmitting the motion is the operator and the other shaft which receives the motion is the user) the connection is carried out either by pulleys and belts, by the gears or by a rods. The two shafts are usually parallel between them. The shafts taken into consideration are called primary or secondary according to the function that each of the two shafts undertakes in the functionality of its use.

There are several problems associated with wringing tools having movable roller pressing on a bent wringing surface.

One problem is caused by the fact that the oscillation angle of the levers supporting the operator roller is identical to that of the hand lever controlling the movement so that the roller distance against the wringing surface is reduced and is shorter than the length of the fringes strip to be wrung. For this reason, at least two further wringing operations are needed in order to cover the whole extension of the fringes strip to be wrung.

Another problem is caused by the fact that in order to increase the oscillation angle of the levers supporting the operator roller in comparison with the oscillating angle of the hand lever controlling the movement, some driving means interpose and force these supporting roller levers' length to be shortened. Consequently the curvature of the wringing surface, against which the roller works, increases. Since the size of the top or upper opening of the wringing tool must be kept open enough for the insertion of the mop to be wrung, the increased bending of the wringing surface causes the opening at the bottom to be reduced.

This causes the problem of not having enough free space to allow the mop and its support to pass through the wringing tool's box structure bottom opening.

In this case, it is necessary to be supplied with a separate rinsing basin in addition to the one below the wringing tool and to make a double movement with the mop and its support. This cause an operator to have to do two different operations therefore demanding increased time.

Rinsing in a basin displaced from the basin below the wringing tool makes it easy to spill fluid with obvious consequences.

A further problem is caused by the driving means which transfer the motion of the shaft moved by the control hand lever to the levers supporting the operator roller, if these driving means are constituted of other levers and rods which are exposed.

Exposed kinematic mechanisms present problems concerning functionality and safety.

A wrong insertion of a mop in the wringing tool can damage the moving parts of the kinematic mechanisms while the accidental insertion of fingers in the kinematic mechanisms can cause serious injury to a person.

There is another problem when the angular movement of the support levers for the operator roller is identical to that of the motion control hand lever. In this case, the angular travel distance without activity going from the rest position where a roller is completely lifted up to its approach to the top edge or border of the wringing bent surface causes needless wear of the wringing tool mechanism.

A further problem comes with the use of a driving means constituted of levers and rods transferring the motion of the shaft moved by the control hand lever to the levers supporting the operator roller. In this case, the angular movement of the control hand lever compared with that of the levers supporting the operator roller, is carried out neither gradually nor according to a logic sequence of demanded efforts because the movement of the different kinematic elements is dependent on the structure. In addition to this, the moving levers stop when the levers are blocked because they interfere against fixed elements. Consequently the extent of the oscillation of the levers supporting the operator roller presents some limits and consequently limits the travel of the operator roller. The wringing tool of the present invention provides a solution for these and other problems.

SUMMARY OF THE INVENTION

The wringing tool of the instant invention has a box structure without a cover and with an open bottom, and idle or wringing roller which is supported on the ends of two oscillating levers, and a hand lever which transmits motion to the oscillating levers supporting the wringing roller by means of gears assembled on a shaft driven by the hand lever itself. In order to make the wringing tool stronger, the oscillating levers may be joined together by a frame forming a support which, on its upper end, terminates in a fork shape for the assembly of a shaft which supports the wringing roller. The box structure of the wringing tool also has a front wall which has seats properly shaped for the assembly of the box structure so that the lower opening is above a basin below. The side walls contribute to support the kinematic mechanisms for moving the pressure roller. The wall opposed to the front bearing wall has a curvilinear shape which is engaged when the mops and/or the fringes strips are wrung by the pressure roller.

Inside the box structure there are no driving means consisting of levers and rods connected to the oscillating levers supporting the roller.

According to the invention the oscillating levers supporting the wringing roller are integral with a shaft supported by the side walls. This shaft mounts at least one roller gear placed outside the aforesaid walls. The roller gear is moved by an inner toothed gear fitted on a shaft moved by a control hand lever. Helical springs are fixed with one end on the side walls and the other end on the outside periphery of the inner toothed gear such that the springs bring the kinematic mechanisms from an end position of the wringing operation to a rest position at the beginning phase. The shaft, which the operator roller idles on, is retained in correspondence to seats placed on the ends of the oscillating levers by screws which engage niches made on the outside surface of the levers. This fact establishes the ease and the functionality of the roller assembly and disassembly thereof (and also of its replacement) by removing or inserting the screws engaged on the lever niches.

DETAILED DESCRIPTION

Figure 2:
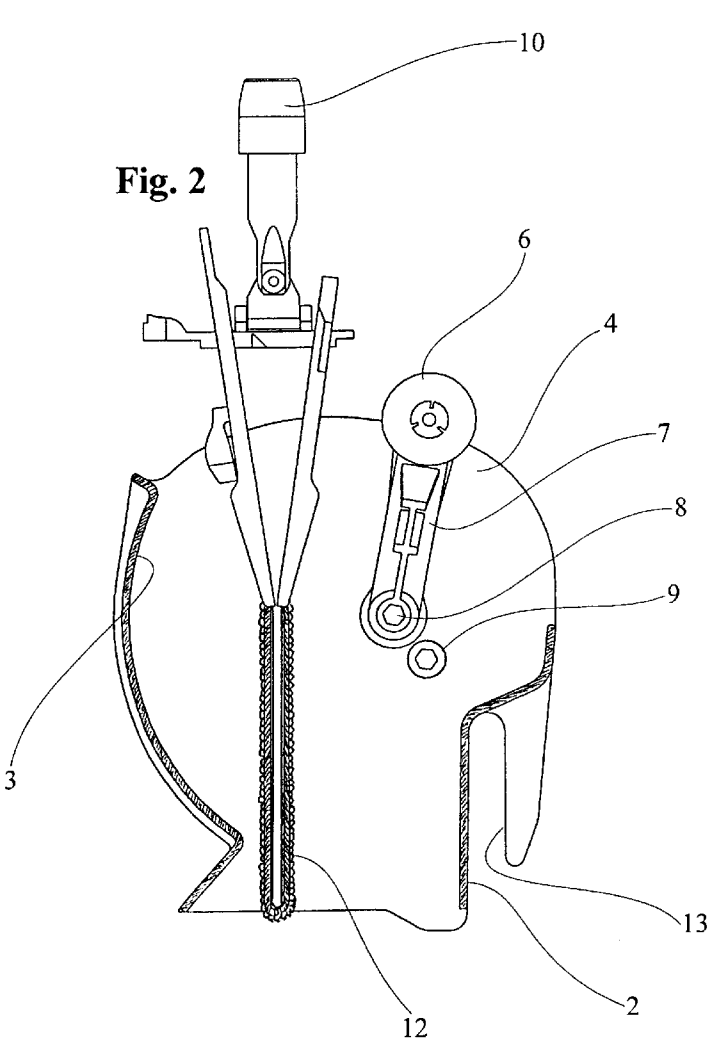
FIG. 2 is a view which corresponds to FIG. 1 where the mop and its support are in an intermediate position inside the wringing tool.
Figure 1:
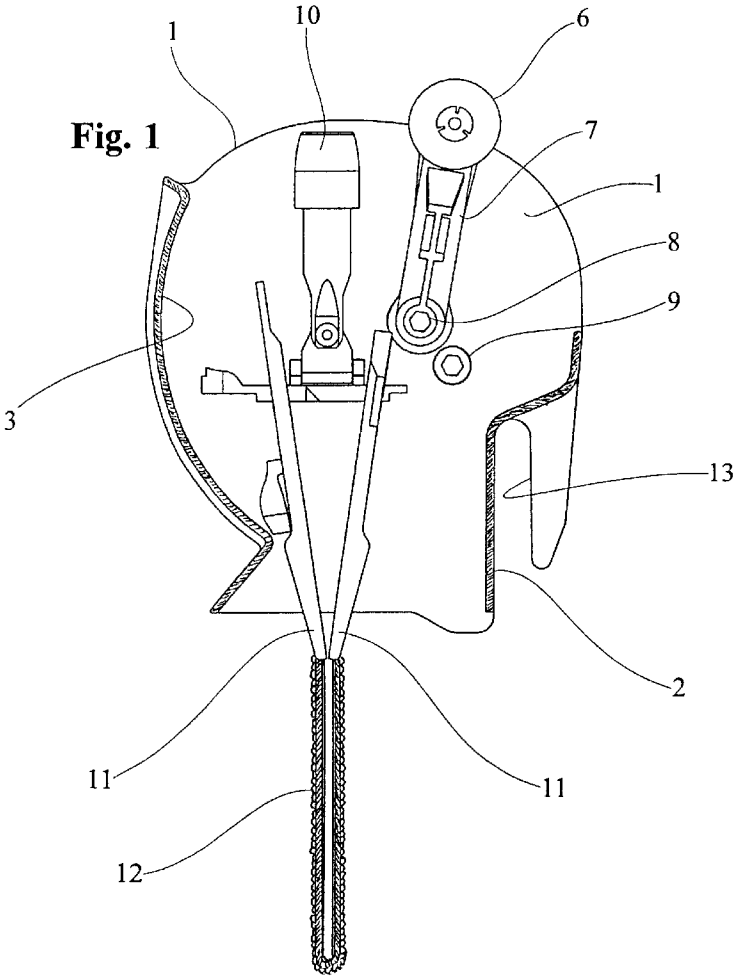
FIG. 1 shows the wringing tool according to a partial vertical sectional view.
Figure 4:
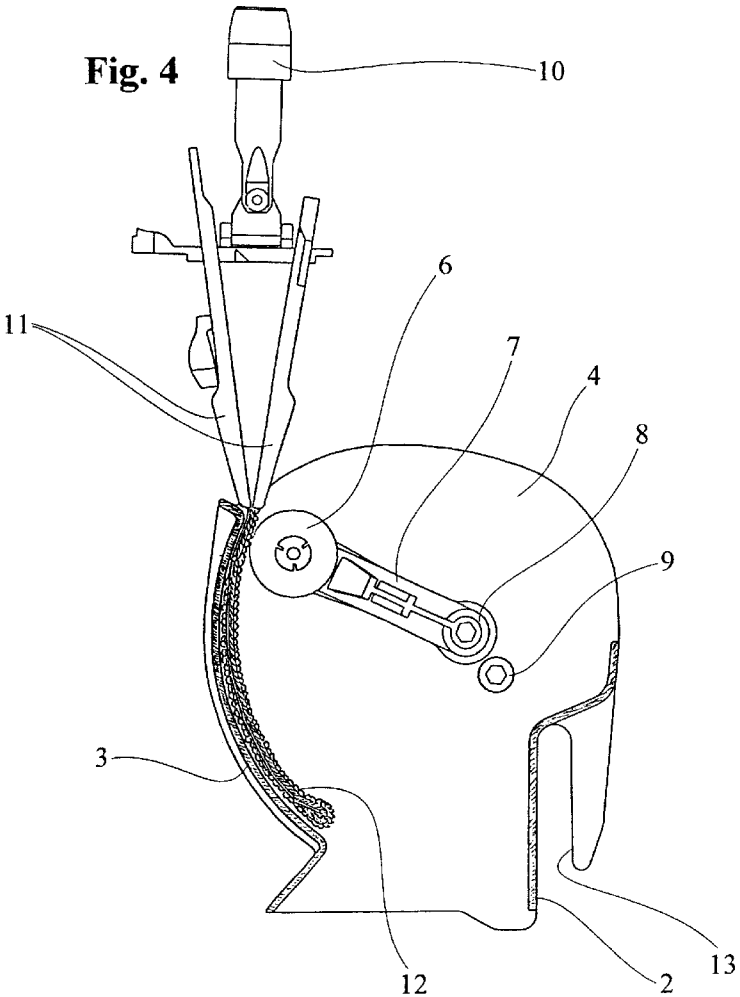
FIG. 4 is a view similar to FIG. 3 showing the operator roller engaged with the mop at the initial wringing position.
Figure 3:
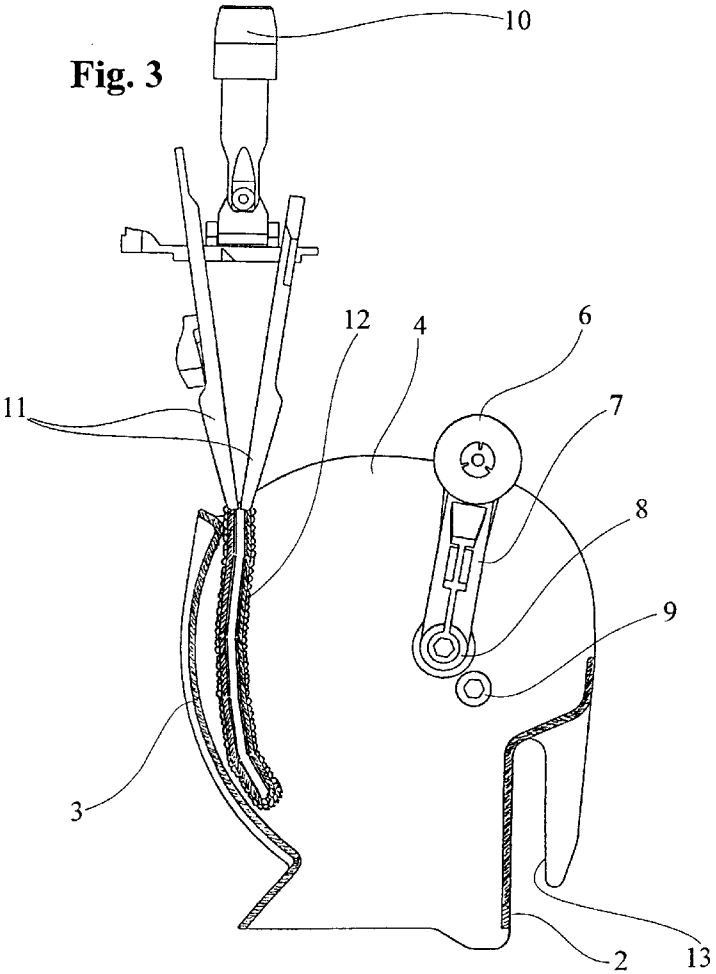
FIG. 3 is a view similar FIG. 1 showing the operator roller at rest.
Figure 6:
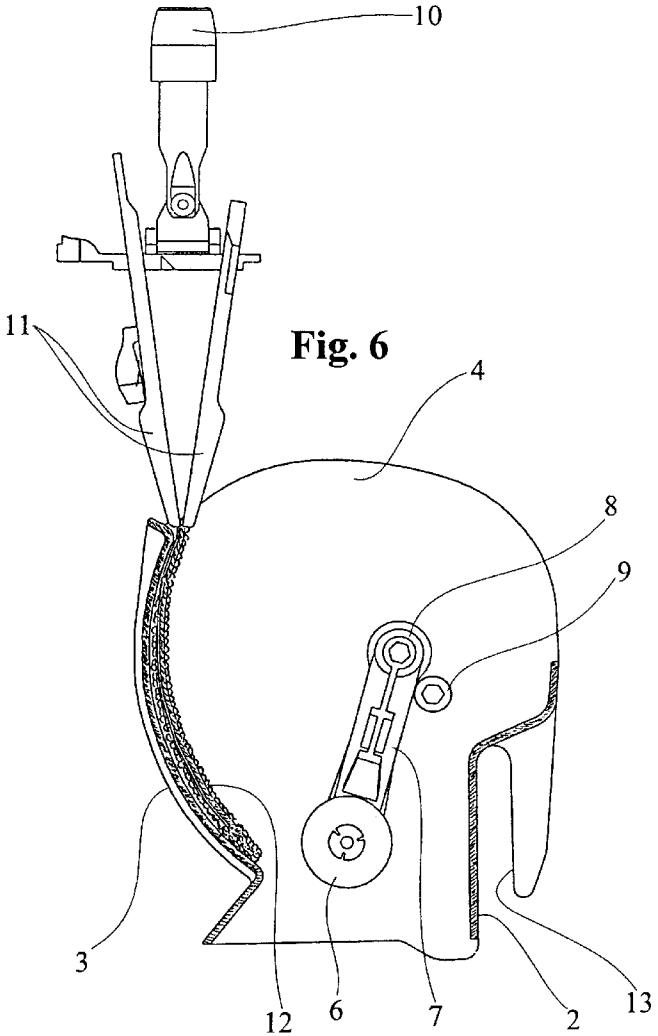
FIG. 6 is a view similar to FIG. 5 showing the operator roller has completed the wringing operation.
Figure 5:
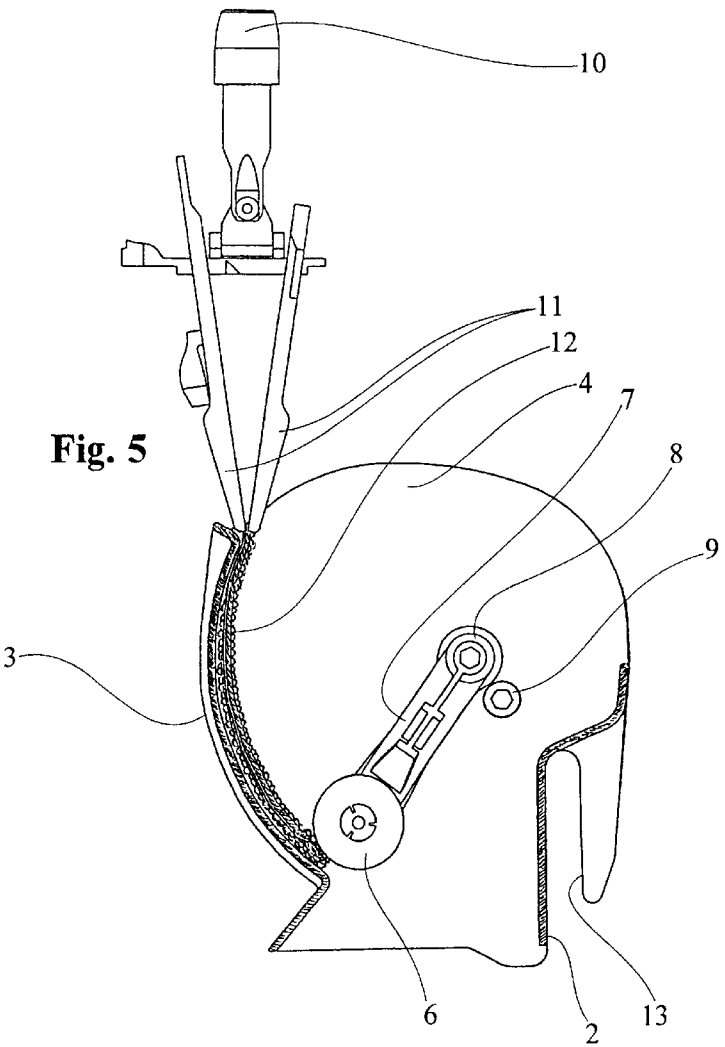
FIG. 5 is a view similar to FIG. 4 showing the operator roller engaged with the mop at the completed wringing position.
Figure 8:
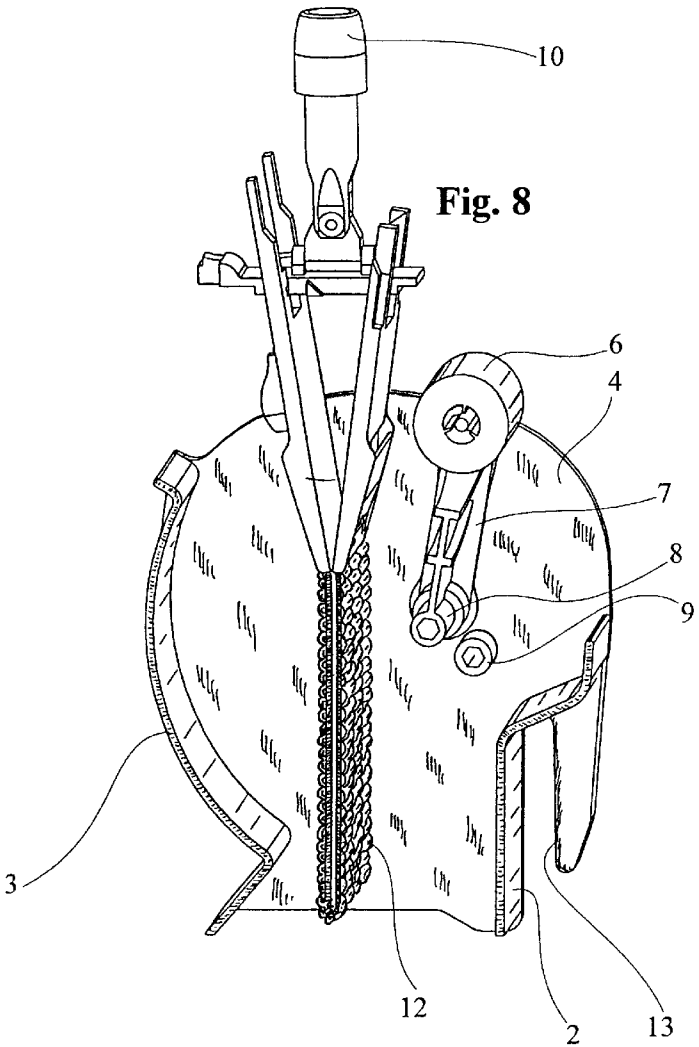
FIG. 8 is a view corresponding to FIG. 2 seen in perspective.
Figure 7:
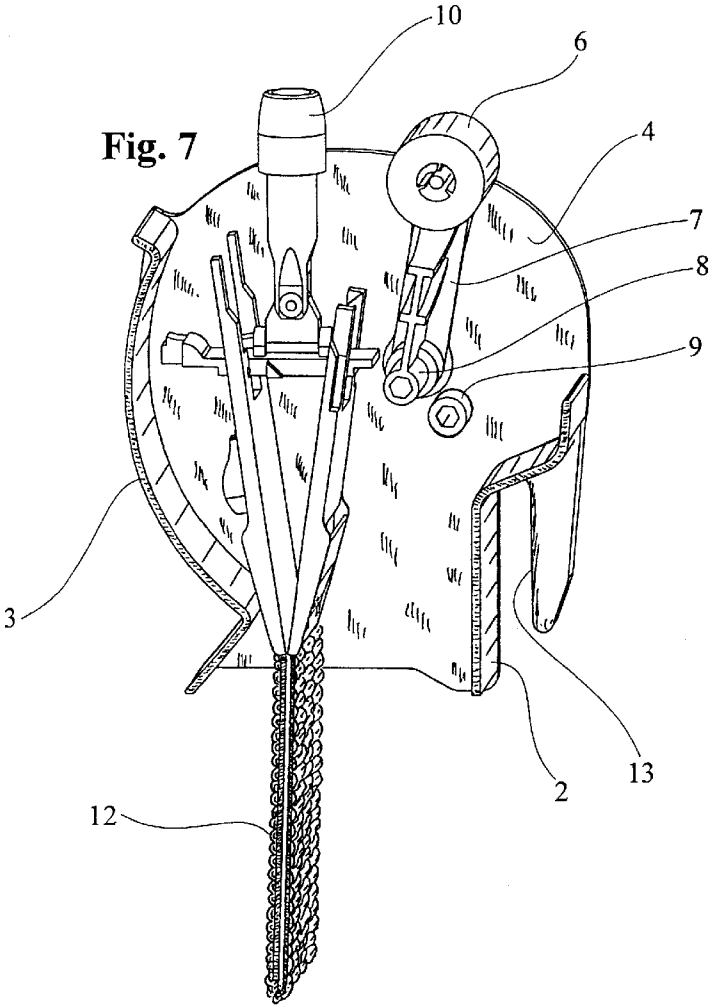
FIG. 7 is a view corresponding to FIG. 1 seen in perspective.
Figure 10:
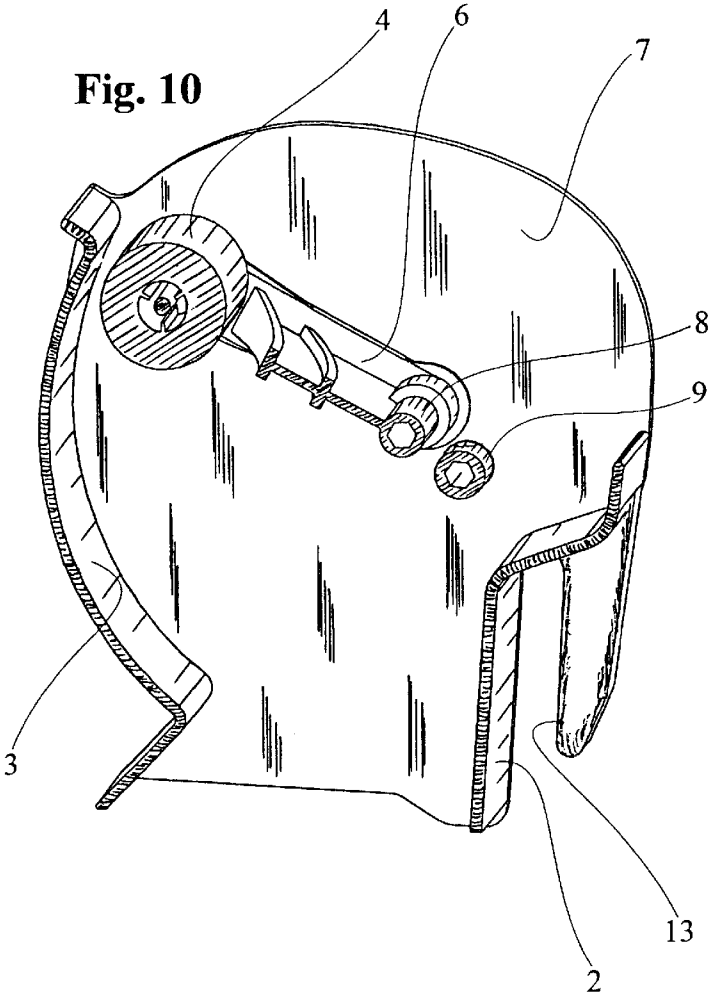
FIGS. 9 through 12 are views corresponding to FIGS. 3 through 6 respectively in perspective with the absence of the mop to be wrung and its support.
Figure 9:
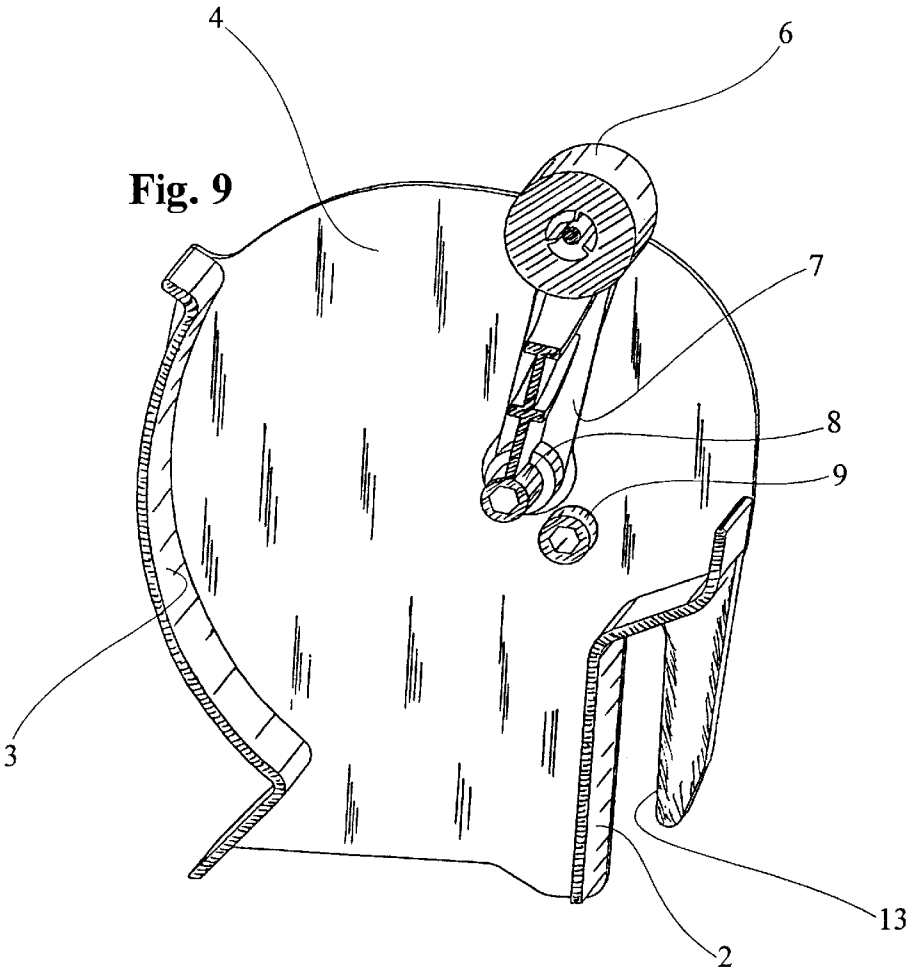
Figure 12:
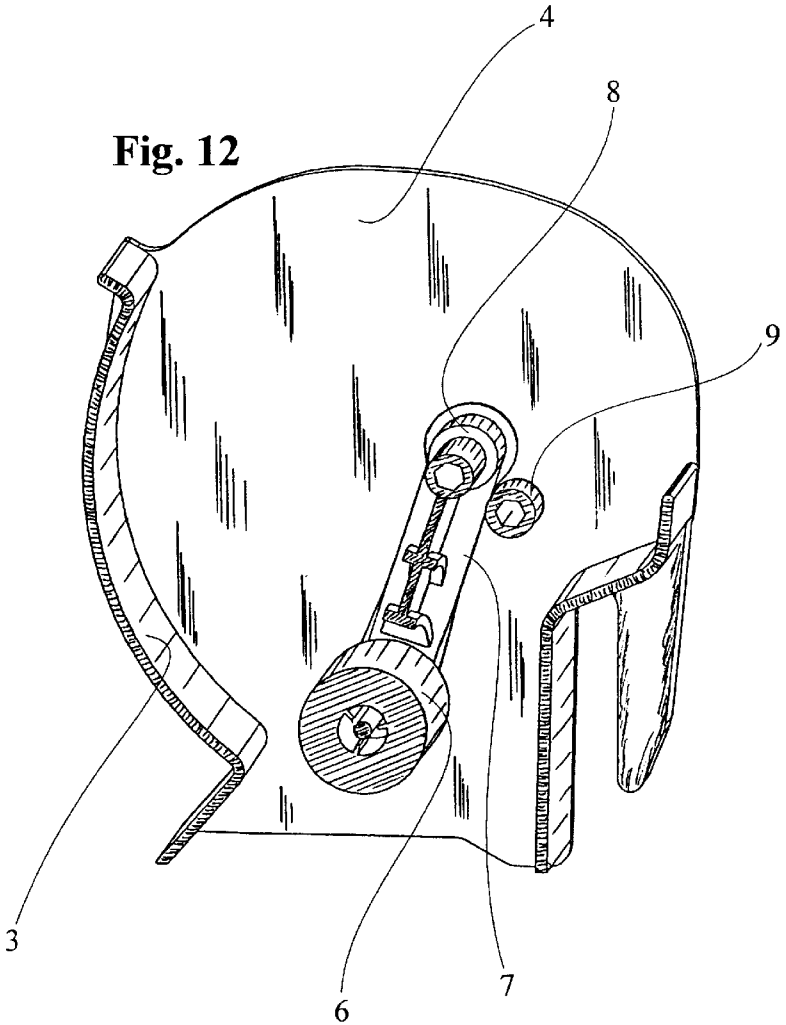
Figure 11:
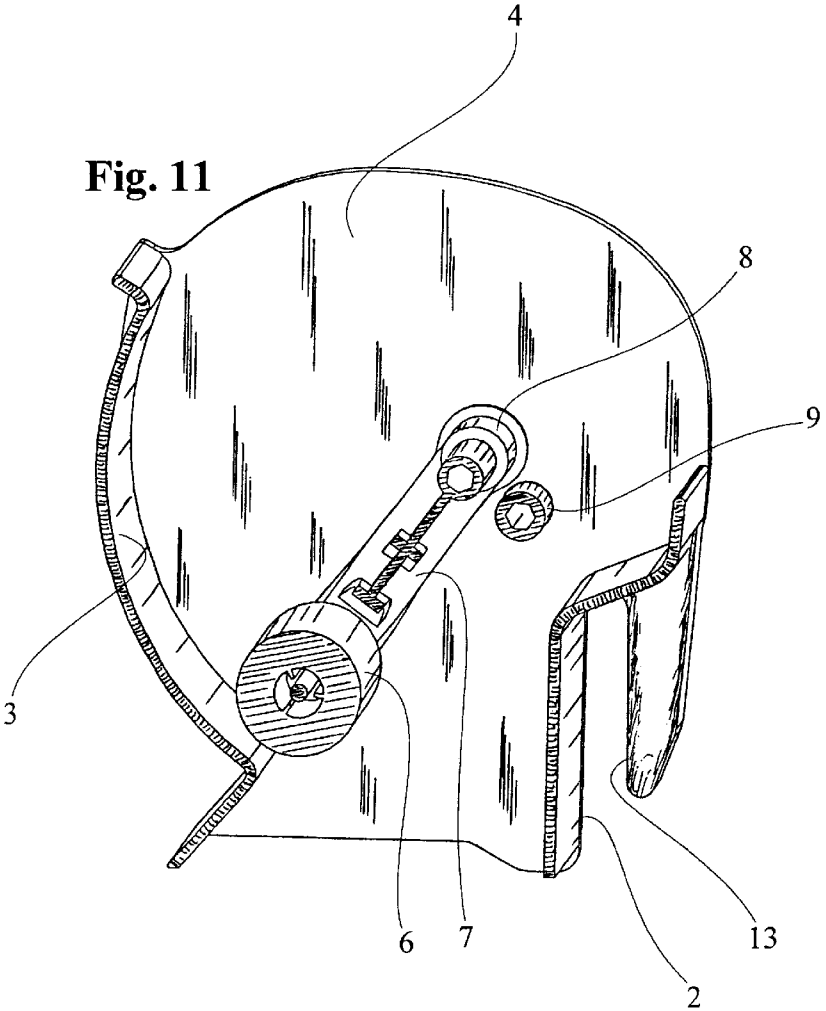
Figures 13, 14:
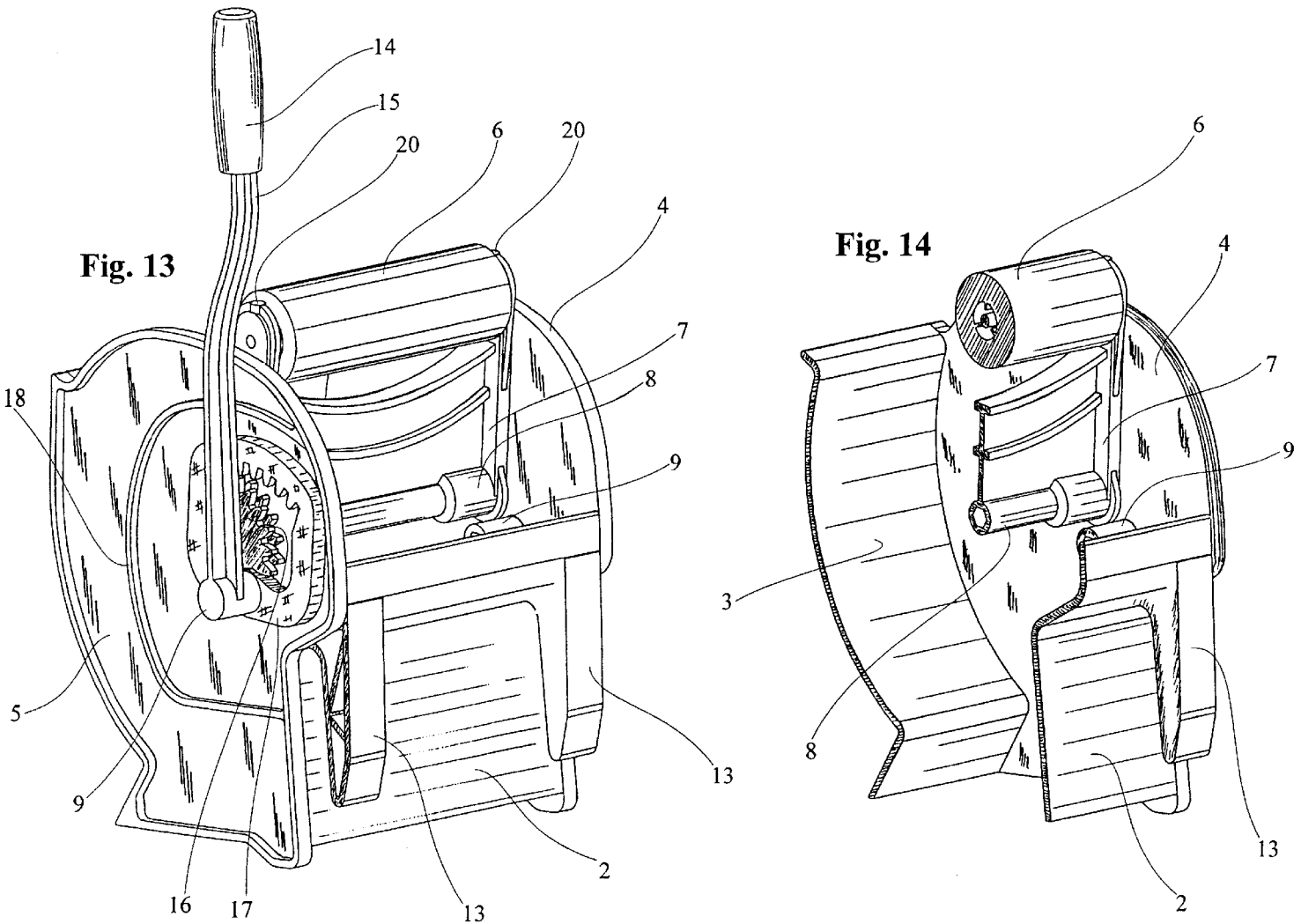
FIG. 13 is a perspective view of the back of the wringing tool.
FIG. 14 is a partial sectional perspective view of a portion of the wringing toll depicted in FIG. 13.

The top opening of the wringing tool's box structure is marked with 1, the front wall is marked with 2 and is equipped with brackets 13 which provide seats for the support of the box structure such that the lower or bottom opening of the structure is above a mop bucket basin. The rear wall (opposed to the front bearing wall 2) which has a curvilinear shape and provides a contrasting or wringing surface is indicated by numeral 3. Mops 12 are inserted adjacent wall 3 and are wrung by a pressure roller 6. Referring to FIG. 1, the operator or pressure roller 6 is shown in an at rest position in which it is spaced a wide distance from the top opening of the curved front wringing wall 3. It is to be noted that a mop 12 (or the fringes strip) and its support 11 mounted on a handle 10 can pass freely through the wringing tool between the top opening and the wall 3 into a lower opening thus enabling the mop to be plunged into a rinse basin below the wringing tool. This ability of the mop and its support to pass through the upper and lower openings of the wringing tool's box structure is one of the invention's main features. Referring to FIG. 3, the mop is set against the bent wringing wall 3 and the support arms 11 are lifted up outside the wringing tool next to the top of the aforesaid bent wringing wall 3. Referring to FIGS. 6 through 8, it may be seen the operator roller 6 has completed wringing the mop and has continued its angular travel detaching itself from the mop, thereby enabling the extraction of the mop by lifting its support.

Figure 15:
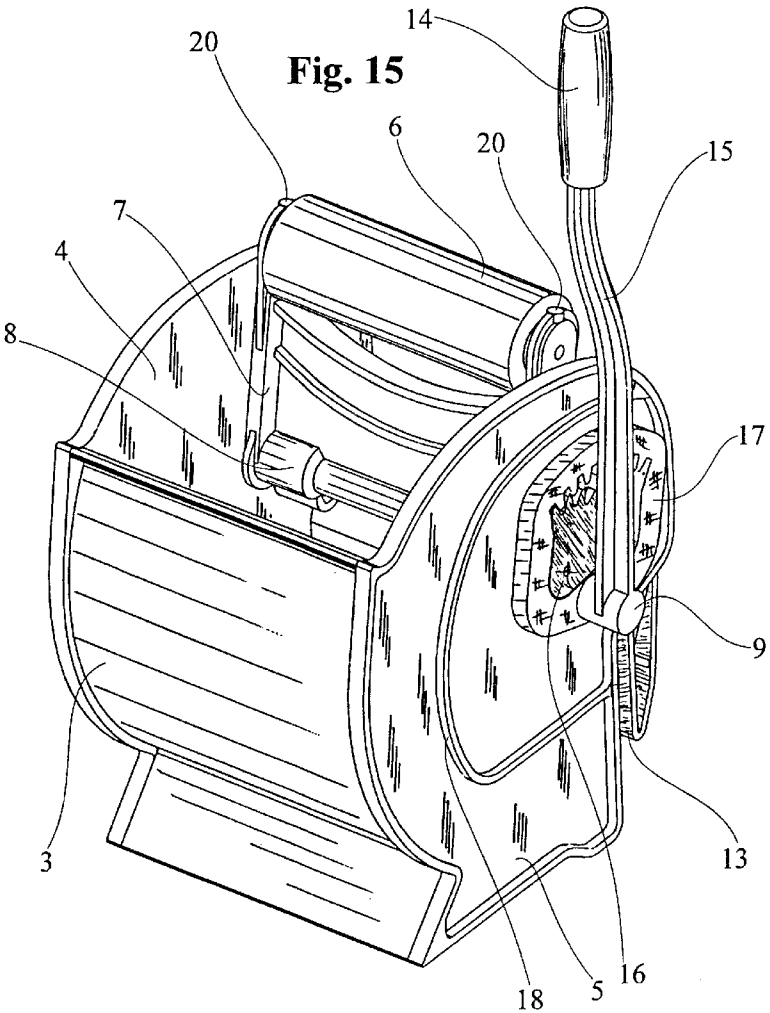
FIG. 15 is a perspective view of one side and the front of the wringing tool where the operator roller and the outside control hand lever are at rest.
Figure 18:
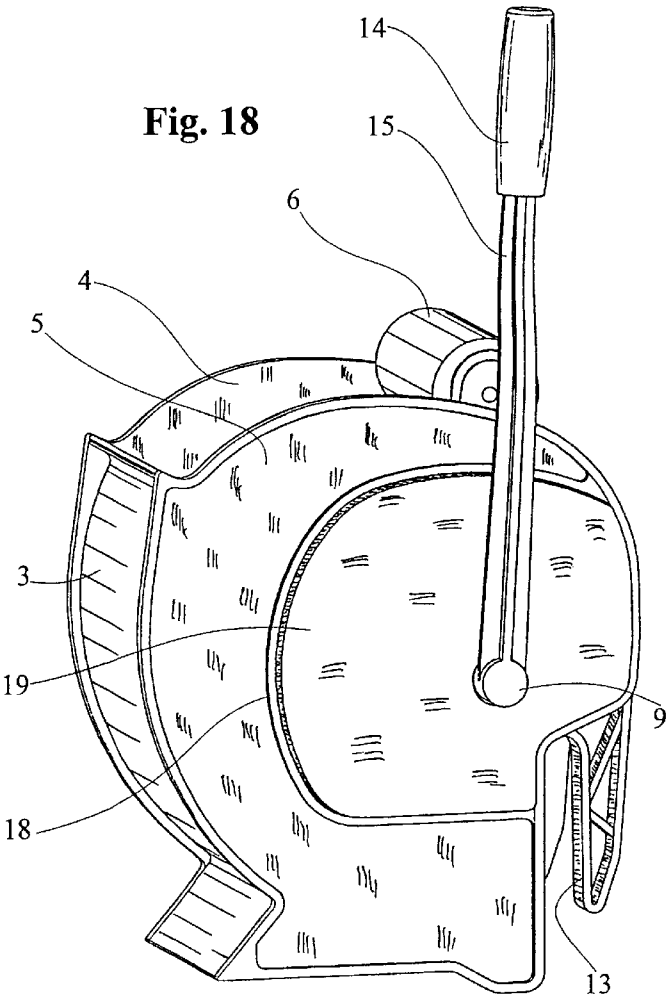
FIG. 18 is a view similar to FIG. 16 showing the wringing tool side wall provided with a cover.
Figure 17:
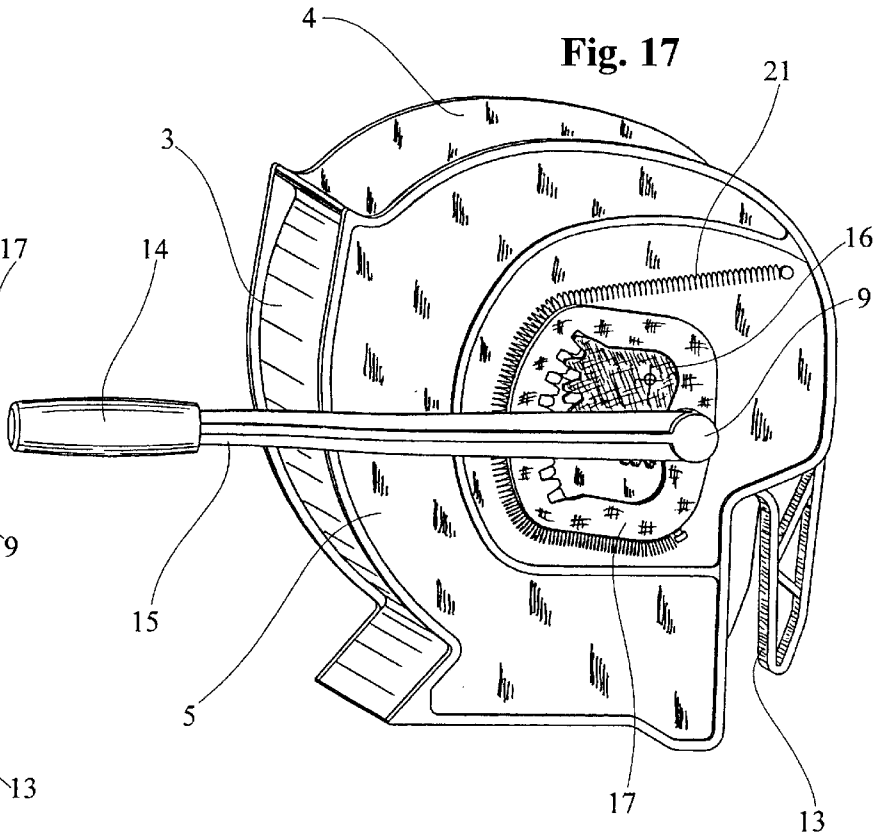
FIG. 17 is a view similar to that of FIG. 16 showing the kinematic mechanisms of the hand lever and the operator roller in a position of maximum travel after the final wringing phase.
Figure 16:
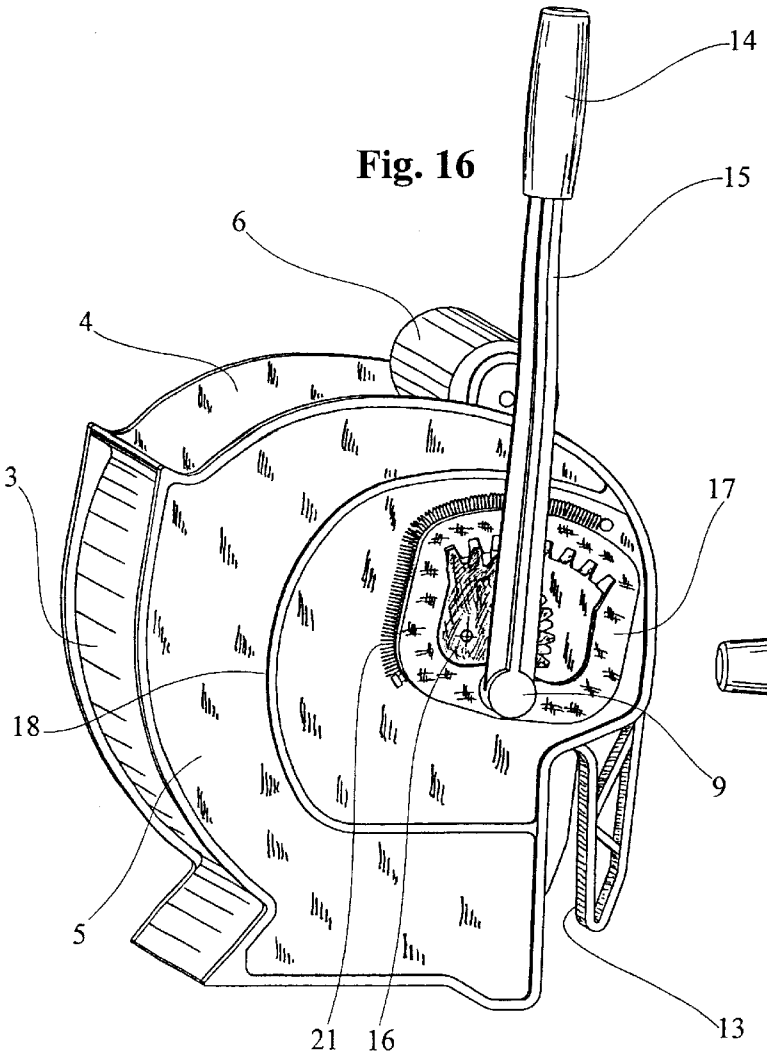
FIG. 16 is a perspective view of the wringing tool of FIG. 15 with the side cover removed.

The side walls which contribute to support the kinematic mechanisms 8, 9 for moving the pressure roller 6 are marked 4 and 5 and the and the oscillating levers are marked 7. Levers 7 are integral with shaft 8 and support pressure roller 6 at its ends. A shaft assembled on a side wall 5 is marked 9. The other side wall 4 also can contribute to the support of the shaft 9. Shaft 9 mounts an inner toothed gear 17 and a control hand lever 15 having a knob 14 adjacent side wall 5 as shown in FIG. 15. A gear 16 fitted on shaft 8 meshes with inner gear 17. Where the operator roller and the outside control hand lever are at rest, oscillatory movement of operator roller 6 is carried out when the inner toothed gear 17 which is integral with the control hand lever 15 and gear 16 on shaft 8 which is integral with the oscillatory levers 7 supporting the operator roller 6 move in response to movement of lever 15. The distances of the steps of the gears' pitch lines involved in the angular travels where the wringing roller 6 is not operative are carried out so as to have a multiplier ratio which is greater than the step where the roller must be operative. It is to be noted that the angular travel of the control hand lever 15 is multiplied by using the transmission of motion by means of gears, which enables the operator roller's angular travel to be greater than that it could be obtained by the driving means through levers and rods which directly work on the oscillating levers supporting the operator roller. It is to be noted also that inside the wringing tool there are no compound levers or rods and that the bend wringing wall 3 is wide enough to contain mops of considerable length. This is due to the equal distance of the wringing wall 3 from the supporting front wall 2.

A protuberance rising from side wall 5 and a roller cover 19 define a guarded space within which the gears 16, 17 move. A helical spring 21 anchored on wall 5 is applied to the periphery of gear 17 to bias the kinematic mechanisms 8, 9, 15, 16 and 17 and the operator roller 6 to the at rest position after wringing operation has been accomplished. Screws 20 and are applied to the ends of the oscillating levers 7 to secure the shaft which supports the pressure roller 6. The screws 20 engage niches in the end of the shaft.

I claim:

1. A wringing tool for a mop which comprises a shaped box structure (1), which is open at the top and at the bottom having two opposed side walls (4,5) providing assembly seats, a lever (7) supporting a wringing roller (6) at one end and attached at the other end to a pivot shaft (8) mounted within the seats in the structure's side walls (4,5), a hand lever shaft (9), a hand lever (15) attached to one end of lever shaft (9) and a gear (17) mounted adjacent said one end of shaft (9), a gear (16) mounted on pivot shaft (8) and drivingly engaged with gear (17), such that oscillating movement of lever (15) causes pivotal movement of lever (7) and roller (6), a wringing wall (3) linking said side wall's (4,5) having a curvilinear shaped wringing surface engaged by said wringing roller (6) during oscillatory movement of the roller and wringing of mops, characterized by the transfer of motion from hand lever (15) to the lever (7) of the wringing roller (6) by means of said gears (16, 17) placed one inside the other one.

2. A wringing tool for a mop, according to claim 1 characterized by lever shaft gear (17) and pivot shaft gear (16) being placed inside a guarded space partially defined by a cover (19) applied to a side wall of the box structure (1).

3. A wringing tool for a mop, according to claim 2 characterized by the top and bottom openings of the box shaped structure (1) are sized to permit the mop and its support to pass through the box shaped structure for rinsing the mop in the water of a basin below the wringing tool's structure.

4. A wringing tool for a mop, according to claim 3 further comprising removable screws (20) which affix wringing roller (6) to the ends of the lever (7) to permit wringing roller (6) to be easily replaced.

5. A wringing tool for a mop, according to claim 4 further comprising a spring (21) having one end affixed to a side wall (5) and the other end affixed to hand lever gear (17) to bias hand lever (15) and wringing roller (6) to a rest position and wherein said spring (21) partially encircles said hand lever gear (17).

6. A wringing tool for a mop, according to claim 3 further comprising a spring (21) having one end affixed to a side wall (5) and the other end affixed to hand lever gear (17) to bias hand lever (15) and wringing roller (6) to a rest position and wherein said spring (21) partially encircles said hand lever gear (17).

7. A wringing tool for a mop, according to claim 2 further comprising spring (21) having on end affixed to a side wall (5) and the other end affixed to hand lever gear (17) to bias hand lever (15) and wringing roller (6) to a rest position and wherein said spring (21) partially encircles said hand lever gear (17).

8. A wringing tool for a mop, according to claim 2 further comprising removable screws (20) which affix wringing roller (6) to the ends of the lever (7) to permit wringing roller (6) to be easily replaced.

9. A wringing tool for a mop, according to claim 8 further comprising a spring (21) having one end affixed to a side wall (5) and the other end affixed to hand lever gear (17) to bias hand lever (15) and wringing roller (6) to a rest position and wherein said spring (21) partially encircles said hand lever gear (17).

10. A wringing tool for a mop, according to claim 1 characterized by wherein the ratio of the distances of the pitch lines of the pivot shaft and lever shaft gears (16, 17) change in correspondence to the different angular positions of the mesh between said gears so as to multiply the hand lever's (15) movement in an inverse order with respect to the wringing effort such that movement of the hand lever (15) causes a corresponding greater angular movement of the wringing roller (6), in particular during the first and last step of the stroke of the wringing roller's (6) lever (7).

11. A wringing tool for a mop, according to claim 10 further comprising removable screws (20) which affix wringing roller (6) to the ends of the lever (7) to permit wringing roller (6) to be easily replaced.

12. A wringing tool for a mop, according to claim 11 further comprising a spring (21) having one end affixed to a side wall (5) and the other end affixed to hand lever gear (17) to bias hand lever (15) and wringing roller (6) to a rest position and wherein said spring (21) partially encircles said hand lever gear (17).

13. A wringing tool for a mop, according to claim 10 further comprising a spring (21) having one end affixed to a side wall (5) and the other end affixed to hand lever gear (17) to bias hand lever (15) and wringing roller (6) to a rest position and wherein said spring (21) partially encircles said hand lever gear (17).

14. A wringing tool for a mop, according to claim 1 characterized by the hand lever (15), and lever shaft gear (17) being positioned on one side of the wringing tool's structure.

15. A wringing tool for a mop, according to claim 14 further comprising removable screws (20) which affix wringing roller (6) to the ends of the lever (7) to permit wringing roller (6)to be easily replaced.

16. A wringing tool for a mop, according to claim 15 further comprising a spring (21) having one end affixed to a side wall (5) and the other end affixed to hand lever gear (17) to bias hand lever (15) and wringing roller (6) to a rest position and wherein said spring (21) partially encircles said hand lever gear (17).

17. A wringing tool for a mop, according to claim 14 further comprising a spring (21) having one end affixed to a side wall (5) and the other end affixed to hand lever gear (17) to bias hand lever (15) and wringing roller (6) to a rest position and wherein said spring (21) partially encircles said hand lever gear (17).

18. A wringing tool for a mop, according to claim 1 characterized by the moving pivot shaft (8), lever (7) and pressure roller (6) being positioned between both sides of the wringing tool's structure (1); the pivot shaft (8) and pressure roller (6) are connected to hand lever (15) by hand lever shaft (9) and pivot shaft (8), which supports the lever being part of the operator roller's (6) supporting element.

19. A wringing tool for a mop, according to claim 18 further comprising removable screws (20) which affix wringing roller (6) to the ends of the lever (7) to permit wringing roller (6) to be easily replaced.

20. A wringing tool for a mop, according to claim 19 further comprising a spring (21) having one end affixed to a side wall (5) and the other end affixed to hand lever gear (17) to bias hand lever (15) and wringing roller (6) to a rest position and wherein said spring (21) partially encircles said hand lever gear (17).

21. A wringing tool for a mop, according to claim 18 further comprising a spring (21) having one end affixed to a side wall (5) and the other end affixed to hand lever gear (17) to bias hand lever (15) and wringing roller (6) to a rest position and wherein said spring (21) partially encircles said hand lever gear (17).

22. A wringing tool for a mop, according to claim 1 characterized by the top and bottom openings of the box shaped structure (1) are sized to permit the mop and its support to pass through the box shaped structure for rinsing the mop in the water of a basin below the wringing tool's structure.

23. A wringing tool for a mop, according to claim 22 further comprising removable screws (20) which affix wringing roller (6) to the ends of the lever (7) to permit wringing roller (6) to be easily replaced.

24. A wringing tool for a mop, according to claim 23 further comprising a spring (21) having one end affixed to a side wall (5) and the other end affixed to hand lever gear (17) to bias hand lever (15) and wringing roller (6) to a rest position and wherein said spring (21) partially encircles said hand lever gear (17).

25. A wringing tool for a mop, according to claim 22 further comprising a spring (21) having one end affixed to a side wall (5) and the other end affixed to hand lever gear (17) to bias hand lever (15) and wringing roller (6) to a rest position and wherein said spring (21) partially encircles said hand lever gear (17).

26. A wringing tool for a mop, according to claim 1 further comprising removable screws (20) which affix wringing roller (6) to the ends of the lever (7) to permit wringing roller (6) to be easily replaced.

27. A wringing tool for a mop, according to claim 26 further comprising a spring (21) having one end affixed to a side wall (5) and the other end affixed to hand lever gear (17) to bias hand lever (15) and wringing roller (6) to a rest position and wherein said spring (21) partially encircles said hand lever gear (17).

28. A wringing tool for a mop, according to claim 1 further comprising a spring (21) having one end affixed to a side wall (5) and the other end affixed to hand lever gear (17) to bias hand lever (15) and wringing roller (6) to a rest position and wherein said spring (21) partially encircles said hand lever gear (17).

* * * * *